US007059900B2

(12) United States Patent
Holliday

(10) Patent No.: US 7,059,900 B2
(45) Date of Patent: Jun. 13, 2006

(54) COAXIAL CABLE SPLICE CONNECTOR ASSEMBLIES

(76) Inventor: Randall A. Holliday, 4360 Augusta Dr., Broomfield, CO (US) 80020

( * ) Notice: Subject to any disclaimer, the term of this patent is extended or adjusted under 35 U.S.C. 154(b) by 0 days.

(21) Appl. No.: 10/885,246

(22) Filed: Jul. 6, 2004

(65) Prior Publication Data

US 2006/0009073 A1 Jan. 12, 2006

(51) Int. Cl.
*H01R 9/05* (2006.01)

(52) U.S. Cl. ..... 439/578; 439/584; 439/585

(58) Field of Classification Search ..... 439/578–585, 439/394, 462

See application file for complete search history.

(56) References Cited

U.S. PATENT DOCUMENTS

| | | | | |
|---|---|---|---|---|
| 3,601,524 A | | 8/1971 | Kauffman | 174/64 |
| 4,053,196 A | * | 10/1977 | Dunaway | 310/68 R |
| 4,346,958 A | * | 8/1982 | Blanchard | 439/584 |
| 5,232,377 A | | 8/1993 | Leibfried, Jr. | 439/320 |
| 5,392,508 A | | 2/1995 | Holliday et al. | 29/751 |
| 5,596,800 A | | 1/1997 | Holliday et al. | 29/751 |
| 5,651,698 A | | 7/1997 | Locati et al. | 439/578 |
| 5,769,662 A | | 6/1998 | Stabile et al. | 439/578 |
| 5,863,220 A | * | 1/1999 | Holliday | 439/584 |
| 5,904,587 A | * | 5/1999 | Osypka et al. | 439/263 |
| 5,938,465 A | | 8/1999 | Fox, Sr. | 439/350 |
| 5,989,058 A | * | 11/1999 | Norgaard | 439/429 |
| 6,089,913 A | * | 7/2000 | Holliday | 439/584 |
| 6,159,046 A | | 12/2000 | Wong | 439/578 |
| 6,168,455 B1 | * | 1/2001 | Hussaini | 439/394 |
| 6,179,656 B1 | | 1/2001 | Wong | 439/578 |
| 6,352,448 B1 | * | 3/2002 | Holliday et al. | 439/585 |
| 6,719,585 B1 | * | 4/2004 | Egbert | 439/578 |

* cited by examiner

*Primary Examiner*—Michael C. Zarroli
(74) *Attorney, Agent, or Firm*—John E. Reilly

(57) ABSTRACT

A splice connector assembly for electrically connecting or splicing cable ends together and is made up of a centering guide having opposed conductor pin-receiving sockets, a crimping member at one end of the body for crimping one cable end to the body with its conductor pin inserted into one of the sockets, and another cable end having its conductor pin inserted into the other socket, the assembly being conformable for use in wall mount applications, e.g., BNC, RCA and F-type connectors, and the connector body may be color-coded to signify intended application of the splice connector for different uses.

20 Claims, 9 Drawing Sheets

COAXIAL CABLE SPLICE CONNECTOR ASSEMBLIES

BACKGROUND AND FIELD OF INVENTION

One aspect of this invention relates to coaxial cable connectors; and another aspect relates to splice connectors for splicing together the ends of coaxial cables, and in further combination with a wall mount.

In coaxial cable installations, it is often necessary to splice the ends of two cables together. In the past, this has been done by exposing the conductor portions at the end of each cable and attaching special connectors to each end; and the special connectors in turn are then interconnected to opposite ends of a common connector body in such a way as to establish an electrical connection therebetween. Accordingly, there is presently an unmet need for a splice connector which will eliminate special end connectors on the end of each cable as well as to achieve a highly secure connection with minimal signal loss.

SUMMARY OF THE INVENTION

It is therefore an object to provide for a novel and improved splice connector for coaxial cable installations; and a splice connector which is adaptable for use in different applications to establish secure interconnection between ends of a pair of coaxial cables to be joined together while avoiding the use of threaded fasteners; and further to provide for a novel and improved method and means for interchangeably connecting different colored bands to a coaxial cable splice connector according to its intended application.

It is a further object to provide for a novel and improved splice connector conformable for use in the interconnection of a pair of coaxial cables in various applications, such as, wall mounts and which eliminates parts as well as requires less space in the installation or assembly of the cable and connector into a wall.

It is still another object to provide for a novel and improved connector body incorporating a starter guide extension for a pin conductor to facilitate blind insertion of the cable into one end of the connector body so as to be precisely centered for insertion of another pin conductor at the end of a second coaxial cable and wherein the connector body is readily conformable for use with different types of connectors including but not limited to BNC, RCA and F-connectors.

In summary, a splice connector has been devised for electrically connecting pin or wire-like connectors at ends of each of a pair of cables, the connector comprising a tubular connector body including a connecting sleeve therein for insertion of one of the ends of the cables, a centering guide of elongated cylindrical configuration, the centering guide being electrically conductive and mounted on one of the conductors, the guide being axially advanced in centered relation to the sleeve, and another of the conductors being inserted into a recessed portion at a leading end of the guide.

In a first embodiment, the splice connector includes wall mounting means for connecting the connector body to a first cable in an electrical outlet box, and an opposite end of the connector body protrudes from the wall mounting means for connection to a second cable. Typically, the connector body would be a BNC, RCA or F-type socket connector and the second cable would be terminated with a corresponding male connector end in which the conductor extends from the male connector for insertion into a recessed portion at a leading end of the centering guide.

In a second embodiment, a corresponding type of splice connector body is employed with a resilient band on its external surface which is color-coded to signify the intended application of the splice connector. The band can be attached to the body after one cable is connected to one end of the centering guide and the centering guide crimped into position in the connector body, after which a second cable is inserted into the opposite end of the splice connector body to complete the connection to the selected electronic component. The color-coded band may be in the form of an endless ring which is manually stretchable over the connector body and releasable to contract into close-fitting engagement with a groove on the body.

The above and other objects, advantages and features of the present invention will become more readily appreciated and understood from a consideration of the following detailed description of preferred and modified forms of the present invention when taken together with the accompanying drawings in which:

DETAILED DESCRIPTION OF FIRST EMBODIMENT

Figure 1:
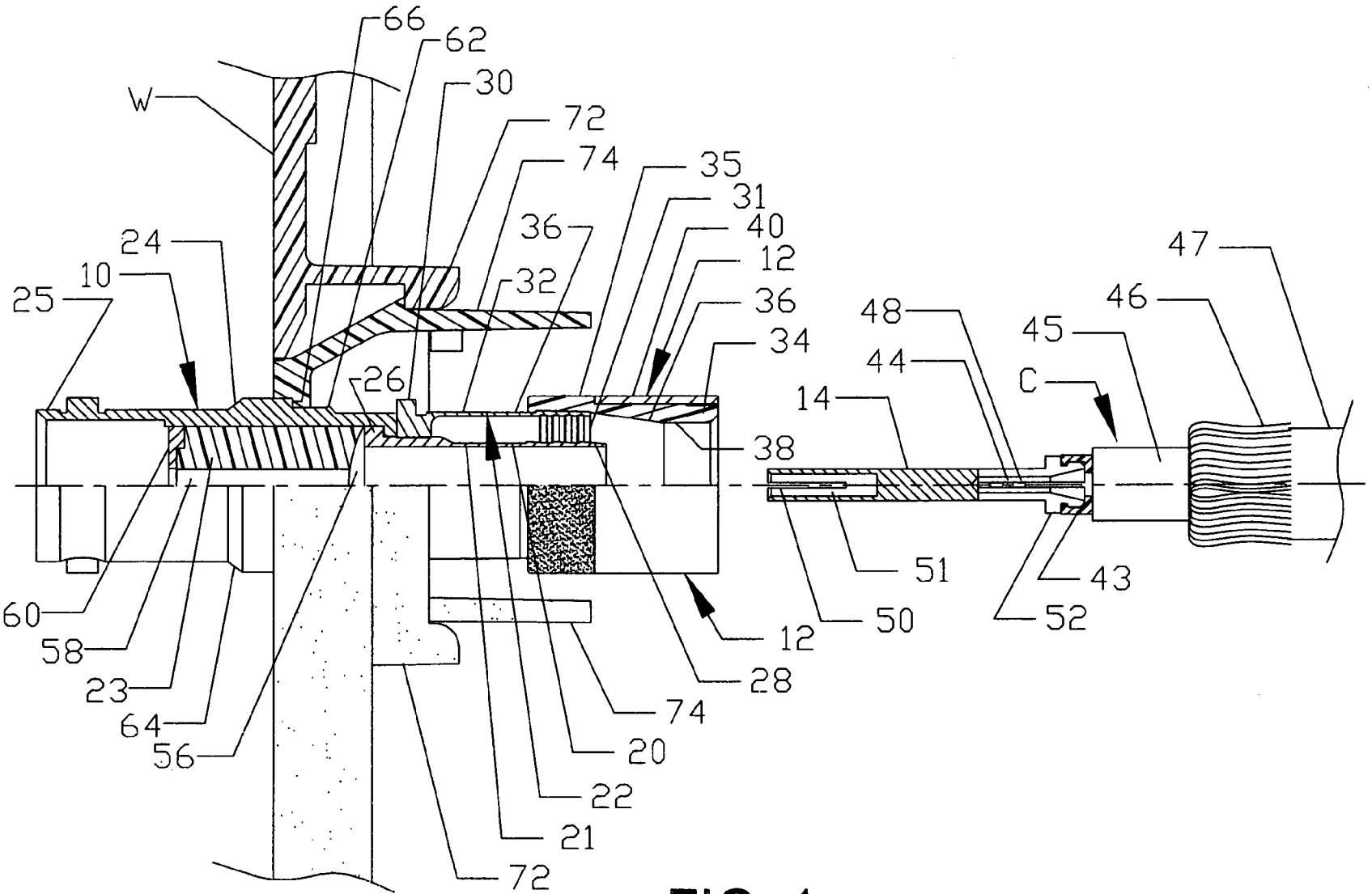
FIG. 1 is a view partially in section of a first embodiment of a splice connection adapted for use in a wall mount and illustrating the initial stages of assembly of a standard coaxial cable with centering guide in relation to a BNC socket-type connector.
Figure 2:
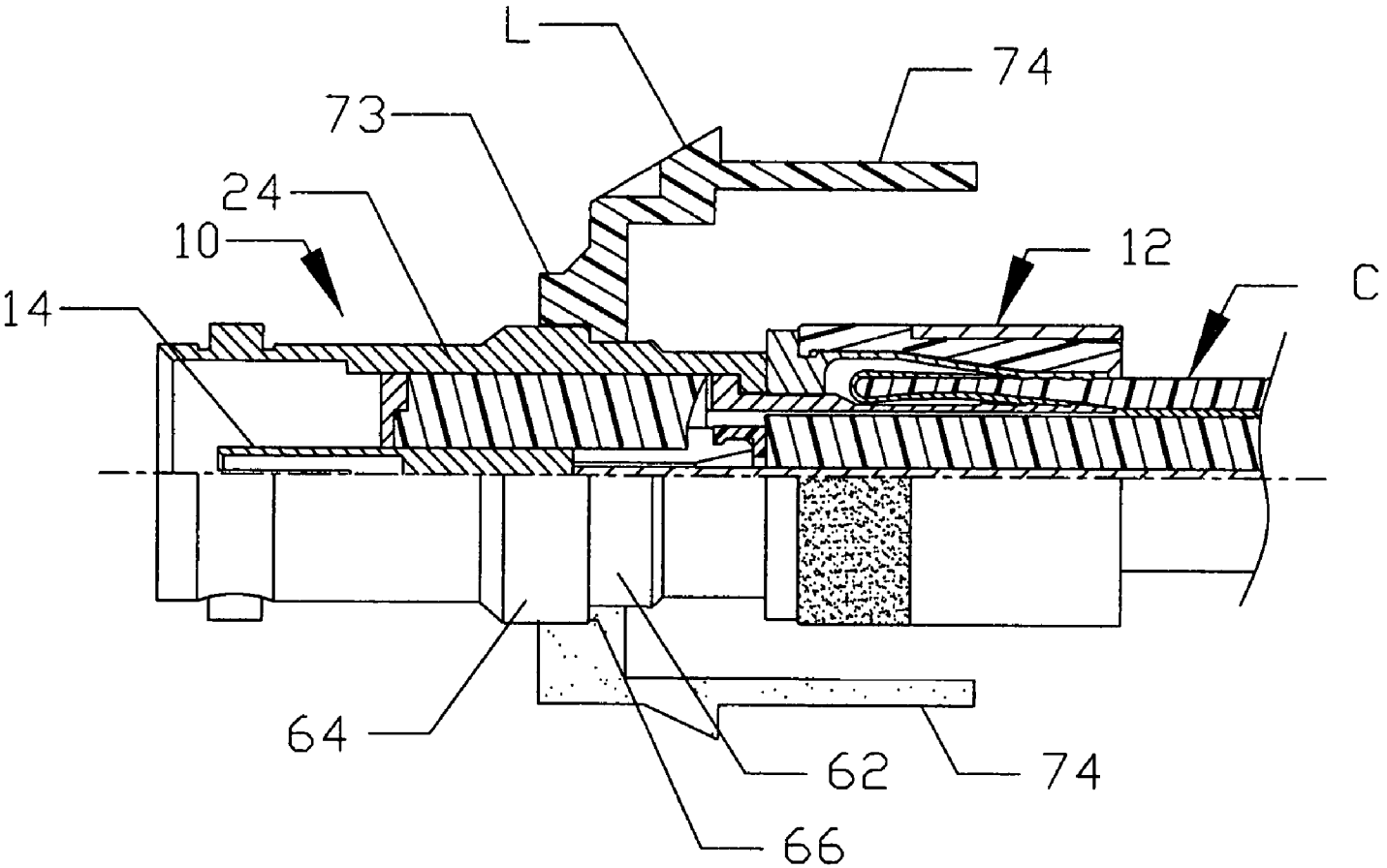
FIG. 2 is another view partially in section of the assembly shown in FIG. 1 with the cable and centering guide inserted into the connector prior to mounting in the wall.

Referring in more detail to the drawings, there is illustrated in FIGS. 1 to 4 a first embodiment of the invention in the form of a wall mount splice connection which is broadly comprised of a female or socket-type connector 10 having a crimping ring 12 at one end, a first coaxial cable C having a centering guide 14, a second connector N having a second coaxial cable C', and a standard clamp L adapted to mount the connector body 10 in a wall plate W which is positioned over an electrical outlet box B in a wall.

The splice connector body 10 is made up of concentrically spaced inner sleeve 20 and outer sleeve 22, the inner sleeve 20 including an inner wall surface 21. The inner sleeve 20 continues into a cylindrical body or barrel portion 24 having an internal sleeve 23 of a non-conductive material and an external shoulder 26, the sleeve 23 defining the smallest diameter of the opening or bore through which the cable C is inserted. A plurality of external serrations 28 on the sleeve 20 are angled in a direction away from the entrance end of the connector 10 which receives the cable C, and the external stop 30 is at one end opposite to a series of endless rings 31 in facing relation to the serrations 28. An external surface 32 of the outer sleeve 22 is of uniform diameter along its greater length to facilitate slidable advancement of the crimping ring 12.

The crimping ring 12 is preassembled on the outer sleeve 22 and includes a hollow cylindrical body 34 composed of a material having limited compressibility, such as, DELRIN® or similar hardened plastic material. The body 34 is relatively thin-walled at the one end 35 which is preassembled over the outer sleeve 22 and is of a diameter slightly less than, or equal to, the external diameter of the outer sleeve 22 so that the crimping ring 12 can be pressfit onto the sleeve. The body 34 gradually increases in thickness away from the end 35 to define a tapered inner wall surface 36 leading into a relatively straight or uniform diameter surface portion 38. Further, the body 34 is undercut or recessed along its external surface to receive a reinforcing band 40 which is preferably composed of a metal, such as, brass. The band 40 fits snugly over the body 34 and is substantially flush with the external surface of the end portion 35.

The coaxial cables C and C' are of conventional construction and each is correspondingly comprised of a central conductor pin 44, a dielectric 45 surrounding the pin, braided electrical conductor 46 and outer insulating jacket 47. The cable end is prepared for insertion into the connector by removing an end portion of the outer jacket 47 and conductor 46, and a shorter length of the dielectric 45 is removed to expose an end of the conductor pin 44 as well as a thin layer of foil (not shown) surrounding the dielectric 45. The braided conductor 46 is peeled away from the insulator 45 and doubled over a forward end of the jacket 47, as illustrated in FIG. 1.

The centering guide 14 is of elongated cylindrical construction having an axial bore 48 at one end for insertion of the pin 44 and a second axial bore or recessed portion 50 at its opposite end adapted for insertion of the extension tip 44'. The wall of the body surrounding the bores 48 and 50 is formed with circumferentially spaced slots 51 to permit limited expansion when the conductor pin 44 and tip 44' are inserted therein. A color-coded insulator 43 is generally cup-shaped and provided with a central bore for insertion of the conductor pin 44 and to effectively insulate the foil layer on the cable C from the centering guide 14. The centering guide 14 includes an enlarged male end portion 52 having continuations of the slots 51 so that, when inserted into the socket end portion 43 on the cable C, the centering guide is securely mounted in place on the conductor pin 44. The insulator 43 is color-coded to designate the size of cable and thereby assure proper matching between the cable C and C' and the connector body 10.

The centering guide 14 is of a length such that when inserted into the connector 10 will advance at least partially through the body or barrel portion 24 before the doubled-over portion 46 of the cable C enters the annular space between the inner sleeve 20 and outer sleeve 22. For this purpose, the centering guide 14 is dimensioned to be of an external diameter substantially corresponding to that of the sleeve 23, and the body or barrel portion 24 is of a length substantially equal to the length of the centering guide and has an annular metal retaining ring 60 at its distal end opposite to the inner sleeve 20 to reinforce and stabilize the sleeve 23 which is composed of a relatively flexible material. Accordingly, the center guide 14 facilitates blind insertion of the cable and assures correct alignment of the doubled-over portion of the braided layer 46 and underlying jacket 47 with the annular space between the sleeves 20 and 22. Furthermore, the centering guide is of a length such that it will extend beyond the barrel portion 24 to a point adjacent to the leading end 25 of the connector body.

Figure 4:
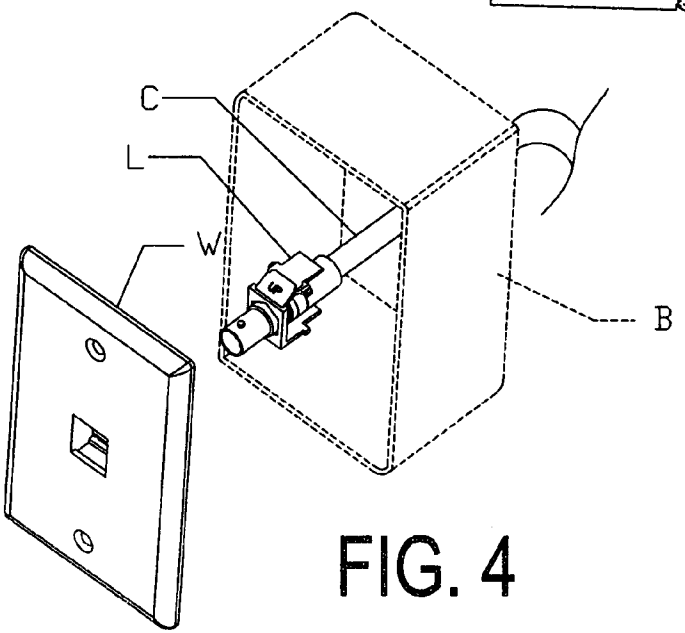
FIG. 4 is an exploded perspective view of the splice connector assembly of FIG. 4 and illustrating the extension of the first cable through an electrical outlet box into one end of the connector body.
Figure 5:
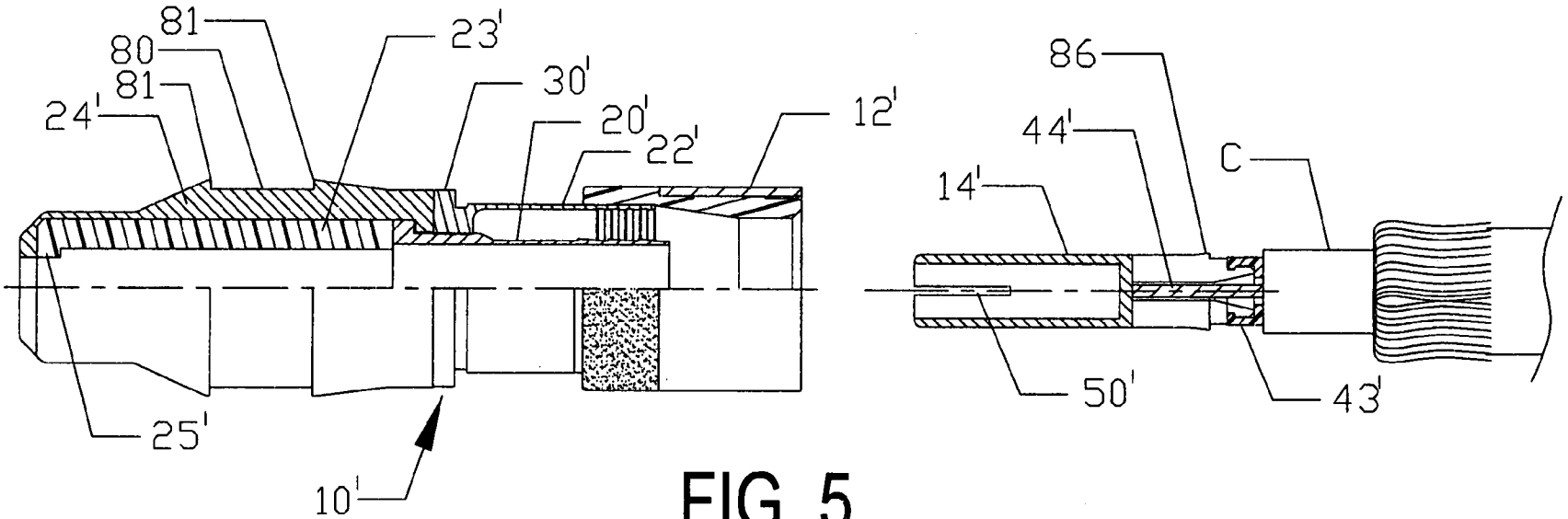
FIG. 5 is an exploded view partially in section of a second embodiment of splice connection utilizing an RCA socket end connector and illustrating a first coaxial cable prior to insertion into one end of the connector.
Figure 6:
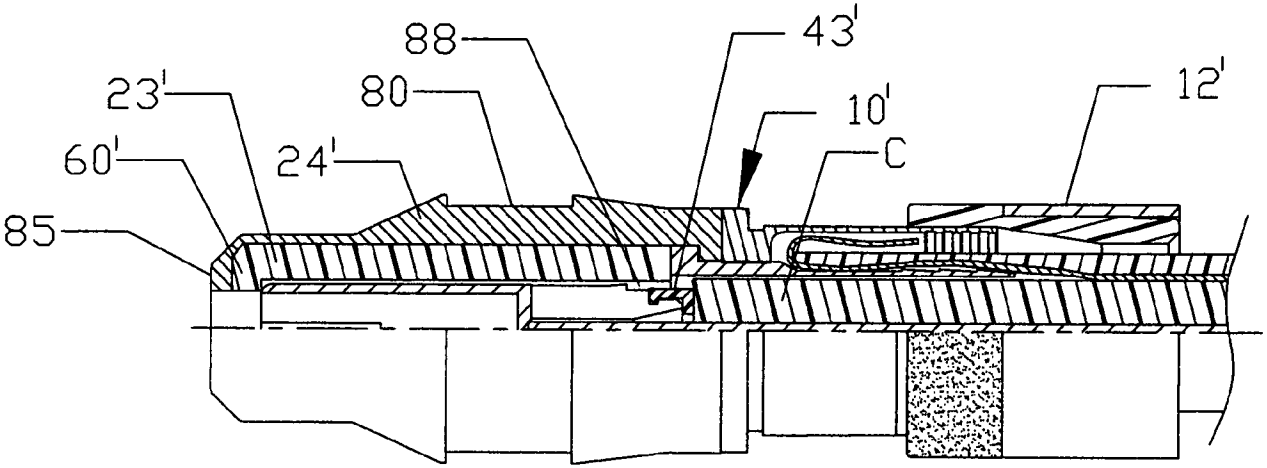
FIG. 6 is a view partially in section of the modified form shown in FIG. 5 after the first coaxial cable has been advanced into the connector but prior to crimping.

The sleeve 23 is of plastic or other insulating material having a beveled annular end 56 which assists in centering the guide 14 for advancement through the center bore 58 of the body and again the metal retaining ring 25 at the opposite end of the sleeve 23 reinforces it. The barrel portion 24 includes adjoining external mounting portions 62 and 64 having a step or shoulder 66 therebetween and dimensioned to receive a conventional clamp L adapted for mounting in a wall plate W. The standard wall plate W typically includes upper and lower ledge portions 72 which extend through the entrance in an electrical outlet box B as illustrated in FIG. 4. One conventional clamp L is based on the Keystone Standards and has a front mounting portion 73 provided with a hexagonal opening which is dimensioned to slide over the mounting portion 62 into abutting relation to the shoulder 66 behind the hexagonal mounting portion 64; and upper shoulder plastic legs 74 will simultaneously move into pressfit engagement with the ledge portions.

Figure 3:
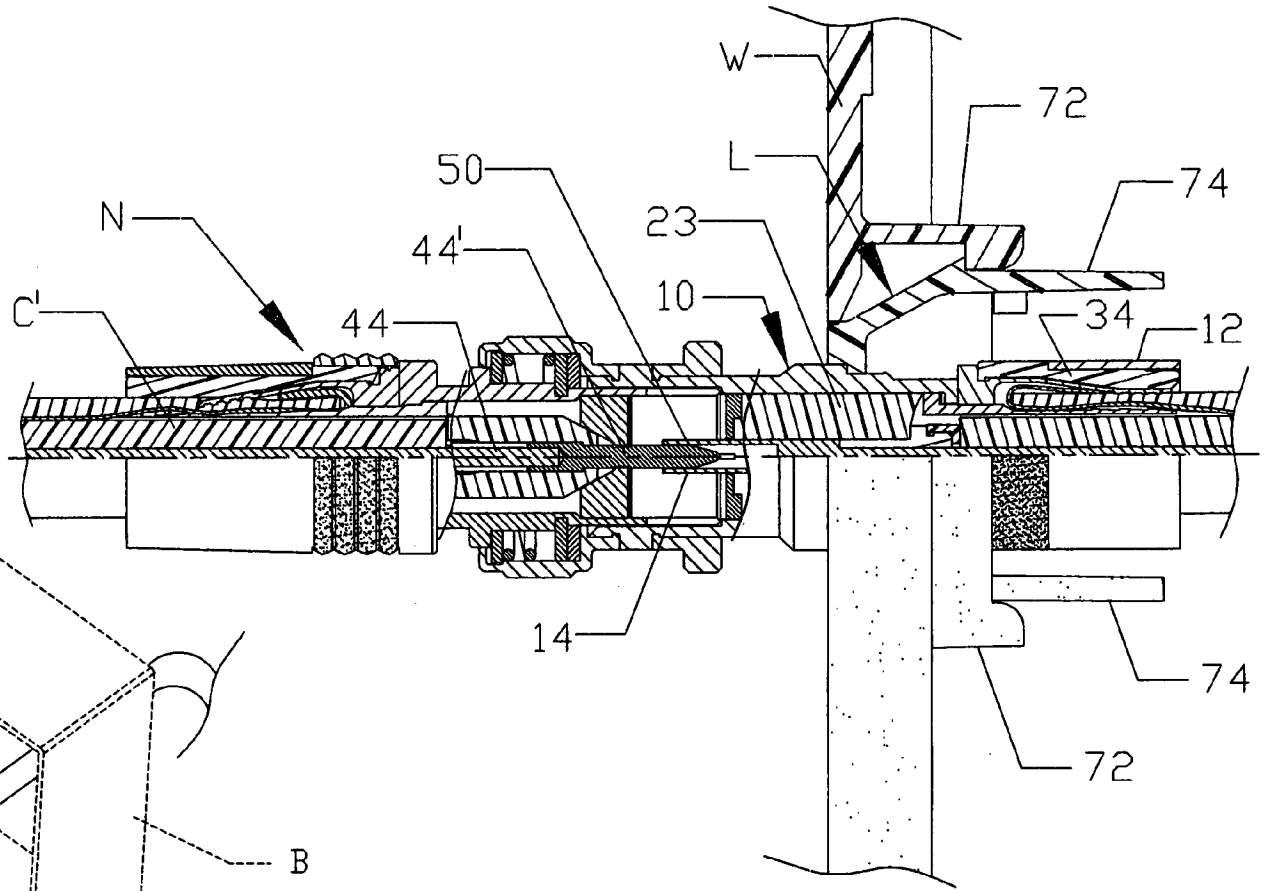
FIG. 3 is still another view of the assembly shown in FIGS. 1 and 2 after the connector body has been crimped onto the end of the cable and then clamped into the wall opening and a second cable inserted into the leading end of the assembled centering guide within the connector body.

In practice, the first cable C and its connector guide 14 which are located in the electrical outlet box B are inserted into the connector body 10 and the crimping ring 12 then advanced over the outer sleeve 22 to securely crimp the end of the cable in position with the connector guide 14 extending through the inner body or barrel portion 24 and terminating just short of the distal end of the body. The clamp L is preassembled on the connector body and forced into position in the wall plate W. The wall plate W is then fastened over the electrical outlet box B in a conventional manner following which the other cable C' is first prepped by exposing the inner pin conductor 44 and flaring the braided layer 46 over the jacket 47 in the usual way. As shown in FIG. 3, the cable C' is mounted in a standard RCA connector N which is then inserted into the end of the connector 10 with the conductor pin 44 and an extension tip 44' aligned for advancement into the bore 50 of the centering guide 14. The bore 50 is dimensioned to be of a diameter slightly less than that of the conductor pin 44 and tip 44' so that the slotted end of the centering guide surrounding the bore 50 will have to undergo a slight expansion to receive the tip 44' in snug-fitting relation and has sufficient resilience to resist any tendency of the pin to accidentally escape from the bore.

DETAILED DESCRIPTION OF SECOND EMBODIMENT

Figure 7:
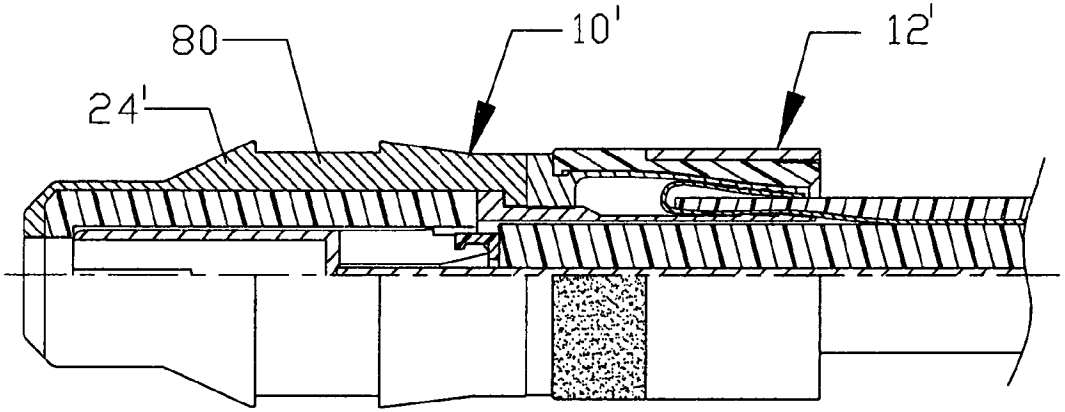
FIG. 7 a longitudinal sectional view of a splice connection utilizing an RCA socket end connector and provided with a mounting portion for a color band.
Figure 7A:
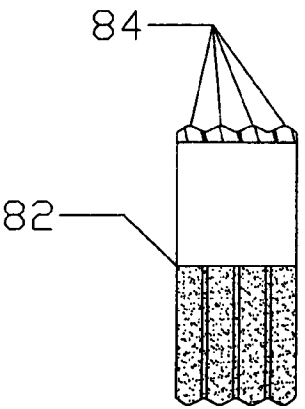
FIG. 7A illustrates a color band to be mounted on the connector body of FIG. 7.
Figure 8:
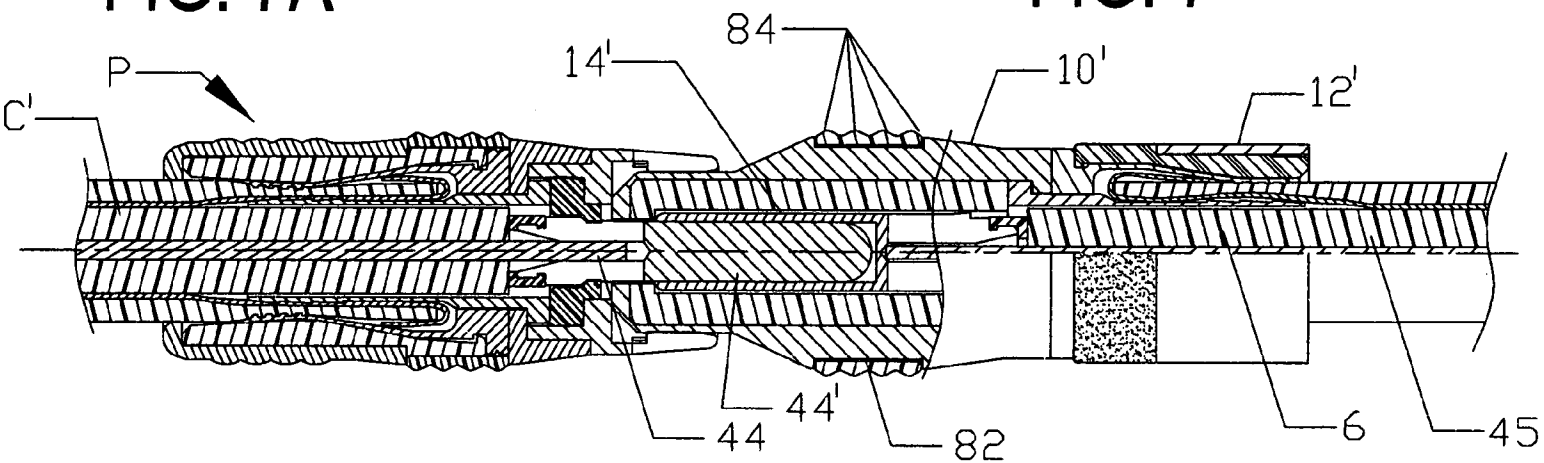
FIG. 8 is another sectional view of the splice connection assembly shown in FIGS. 7 and 7A after the color band has been mounted on the connector body and a second cable is mounted in the leading end of the connector body.

FIGS. 5 to 8 illustrate another embodiment of the present invention and which illustrates the same form of splice connection as in the first embodiment of FIGS. 1 to 4 but for an RCA connector and wherein like parts are correspondingly enumerated with prime numerals. The RCA connector body 10' is of approximately the same length as the BNC connector 10 of FIGS. 1 to 4 but is of a greater diameter to accommodate a larger diameter of male connector P as well as a larger conductor pin 44 and extension tip 44'. Also, the connector body 10 is not designed to support a clamp for a wall mount as described in FIGS. 1 to 4. Instead, the external wall of barrel 24' is provided with an external circumferential groove 80 between shoulders 81 adapted to receive a color band 82, as illustrated in FIGS. 7, 7A and 8. A complete set of different colored bands 82 is furnished for the installer, each band being correspondingly sized to fit into the groove 80. Each band is composed of an elastic material which can be expanded to slide over the connector body 10' from either end and aligned with the groove whereupon it is released to contract into position between the shoulders 81. In the form of band illustrated in FIGS. 7 and 8, the external surface of the band is provided with a series of circumferentially extending ribs 84 so as to facilitate gripping of the band when installed. Further, each band 82 is of a width corresponding to the width of the groove 80 and of a thickness substantially corresponding to the depth of the groove 80.

The band 82 is color-coded or dyed in accordance with a standard color code for the industry. For example, audio connectors may be a combination of a red band for one connector and black or white band for the other connector; video components requiring three connectors may be a combination of one red band, a blue band and green band, respectively, for each connector; and television or VCR units may be a yellow band for a video connector, white for a composite audio connector, and a red band for composite audio connector. Accordingly, the use of sets of color bands which can be placed on each connector according to its intended application obviates carrying a sufficient number of connectors to meet each contingency out in the field for a given connector use, type and frequency. Thus, the user or installer can identify the specific application after installing a particular size and frequency of cable into the splice connector.

The inner concentric sleeve 23' extends the substantial length of the barrel 24' and is composed of an electrically non-conductive material, such as, a hardened plastic and terminates at one end of the connector body opposite to the crimping ring 12' in an annular return 25' which abuts a radial end stop 85 on the barrel 24'.

The centering guide 14' corresponds to the guide 14 of FIGS. 1 to 4 but includes an external shoulder 86 which is engageable with a rib 88 at an opposite end of the body or barrel portion 24' to the stop 25'. The rib 88 assures a positive connection of the centering guide to the sleeve 23' when the cable C is advanced into the connector body, for example, as shown in FIG. 7. Furthermore, the centering guide 14' is of a length such that its leading end will move into engagement with the stop 25' as the shoulder 86 moves into engagement with the rib 88. In this relation, the cable C' is connected to the centering guide 14' by advancing into the bore 50'. Typically, as shown in FIG. 7 the conductor pin 44 of the cable C' would be installed into a second RCA connector 90 having a leading end 92 which is slotted as at 93 for pressfit overlapping engagement with the thin-walled end of the barrel 24'.

Figure 9:
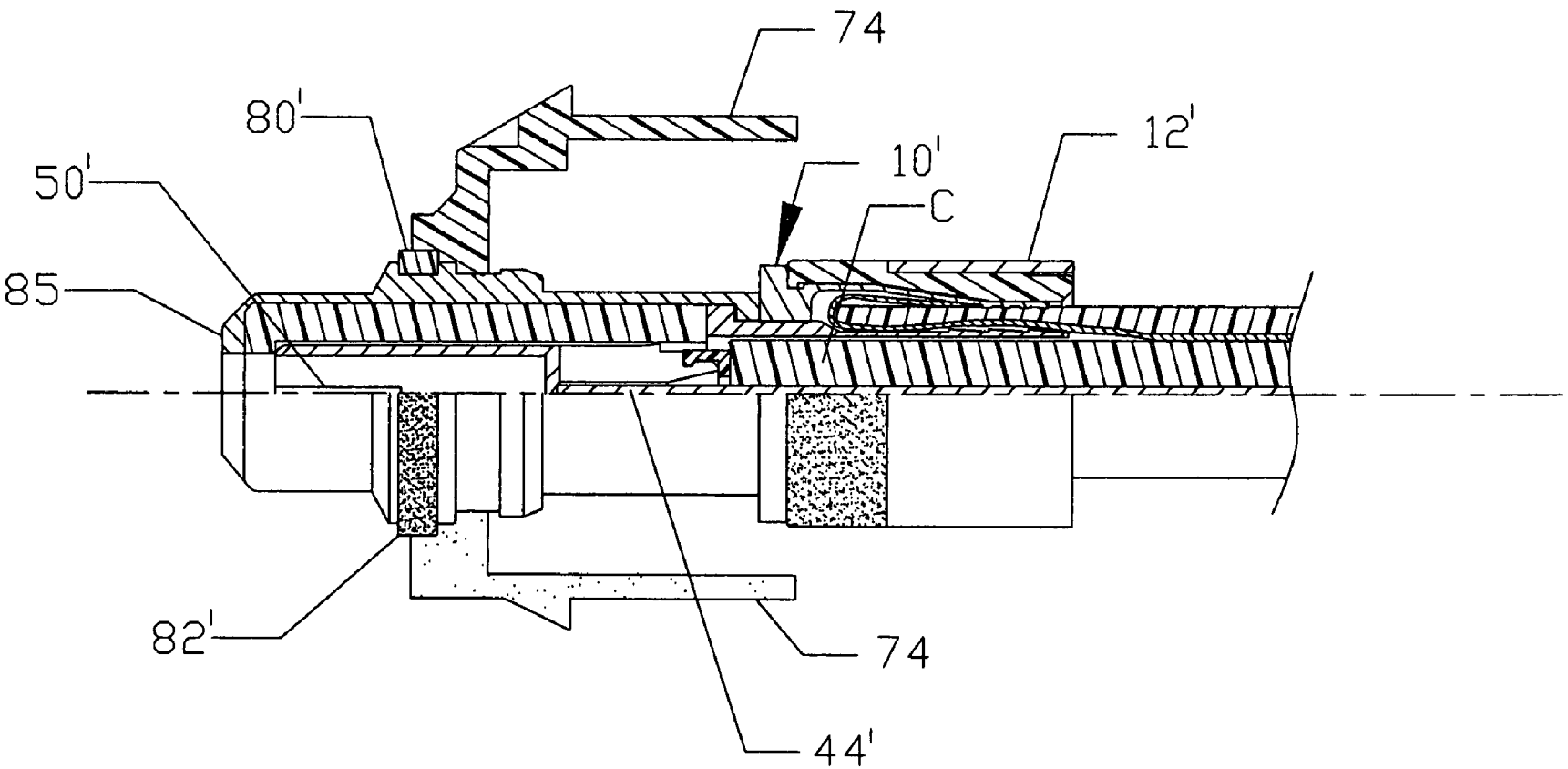
FIG. 9 is a longitudinal sectional view of a wall-mounted RCA splice connector assembly after the connector body has been crimped onto the end of one cable and mounted in a wall plate together with a color band mounted on the connector body.
Figure 10:
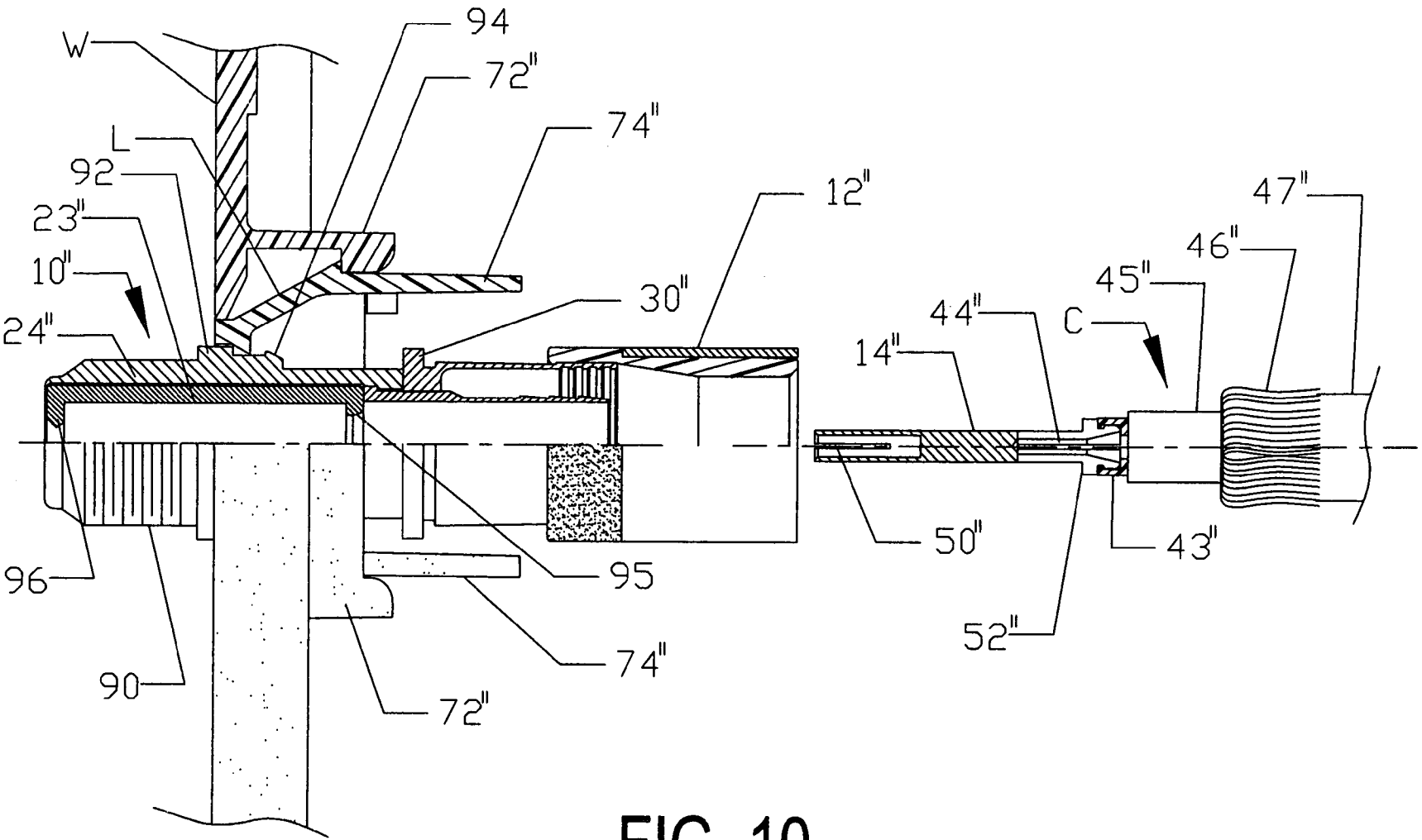
FIG. 10 is an exploded view partially in section of a wall-mounted splice connection assembly for an F-connector.

It will be evident from the foregoing that the barrel 24' of the RCA connector 10' can be modified with external mounting portions corresponding to the mounting portions 62 and 64 of FIGS. 1 to 4 to make it adaptable for use as a part of a wall mount assembly as described in connection with FIGS. 1 to 4. Conversely, the barrel 24 of the first embodiment of FIGS. 1 to 4 may be modified to include a groove 80 for the purpose of receiving a color band 82 in the same manner as described with reference to FIGS. 5 to 9. In this relation, FIG. 9 illustrates a splice connector assembly having both the mounting portions 62' and 64' to make it adaptable for use as a part of a wall mount assembly and also includes a groove 80' for insertion of a color band 82'. Further, the conductor pins 44 either may be a hollow or solid metal pin or wire strands; and therefore any reference to the pins 44 or 44' is intended to include pin or wire-type constructions.

DETAILED DESCRIPTION OF THIRD EMBODIMENT

Figure 11:
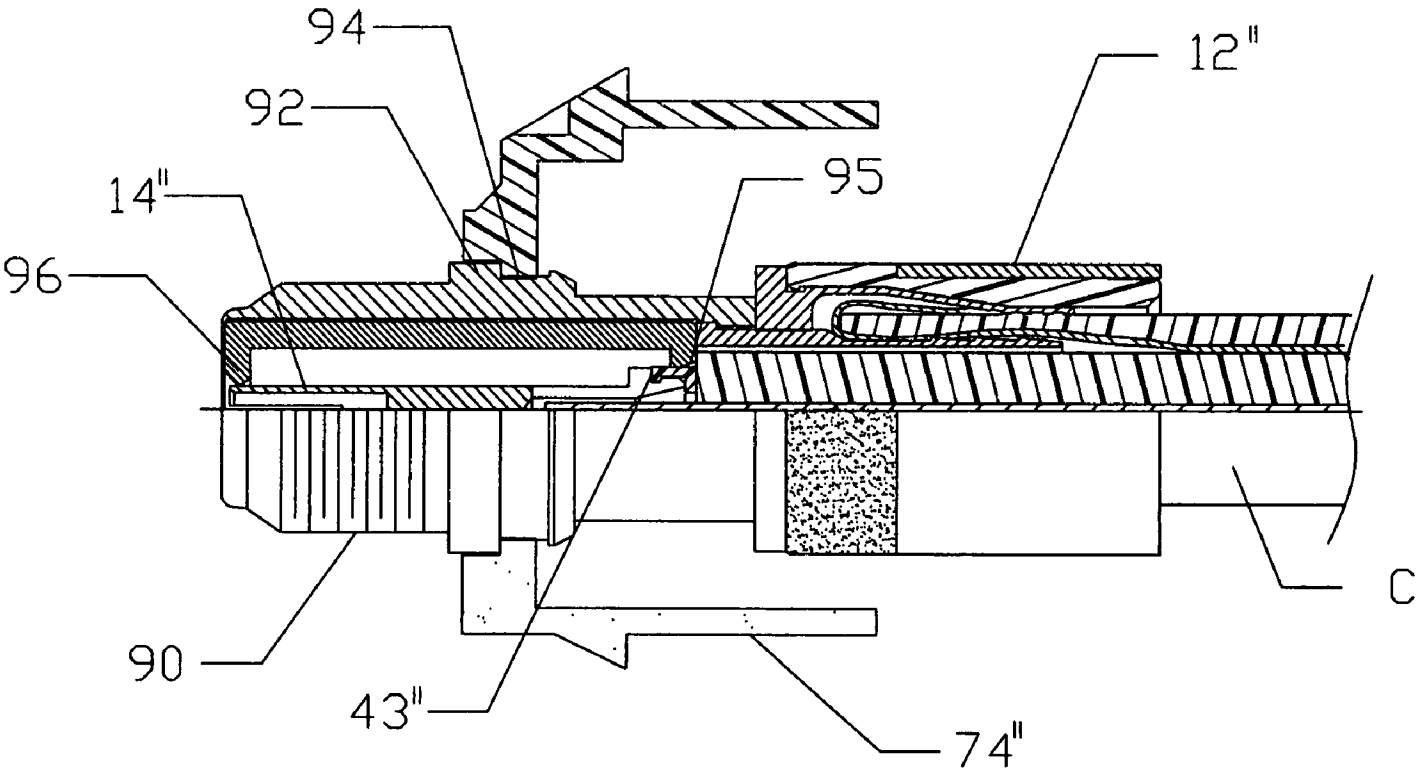
FIG. 11 is a longitudinal section view of the assembly shown in FIG. 10 after the connector body has been crimped onto the end of the first cable and prior to insertion through a wall mounting plate.
Figure 12:
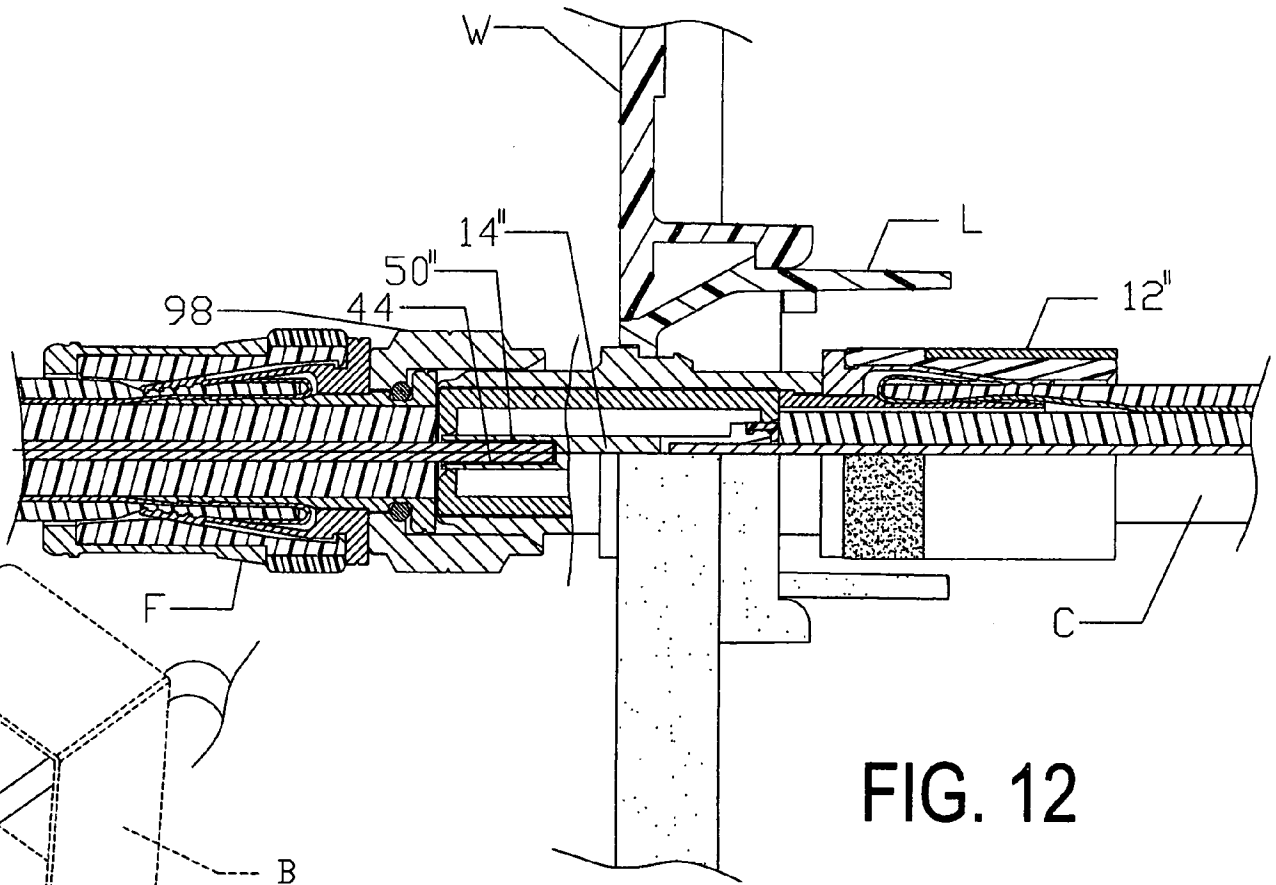
FIG. 12 is a view partially in section of a completed wall mount installation of an F-connector assembly.
Figure 13:
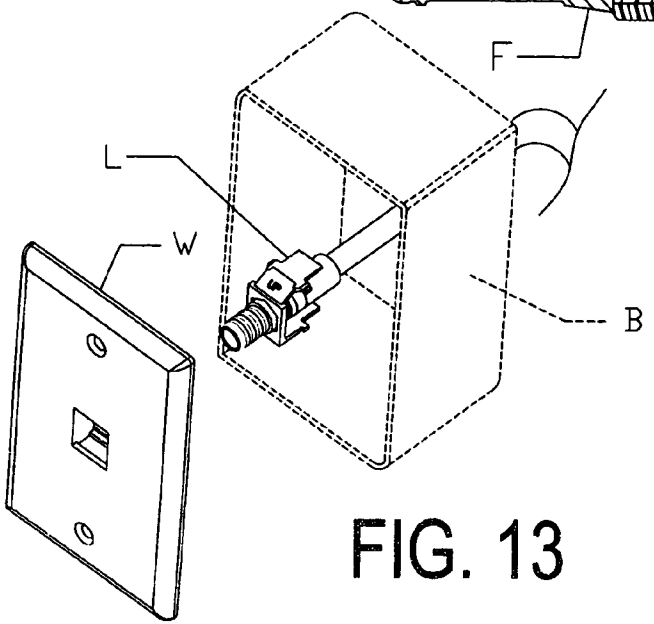
FIG. 13 is an exploded perspective view of the splice connector assembly of FIGS. 10 to 12 and illustrating the extension of a first cable through an outlet box into one end of the connector body.

There is illustrated in FIGS. 10 to 13 a third embodiment of the present invention utilizing once again the same splice connection as in the first embodiment for wall mount applications but for F-connectors instead of the BNC connector. Once again, like elements to those of FIGS. 1 to 4 are correspondingly enumerated with double prime numerals and is broadly comprised of a socket-type connector 10" having a crimping ring 12" at one end, a first coaxial cable C having a centering guide 14", a second coaxial cable C', and a standard clamp L for mounting the connector body 10" in a wall plate W. The wall plate W is positioned over an electrical outlet box B which, as best seen from FIG. 13, is adapted to be positioned in a well-known manner in a wall opening.

In this form, the barrel 24" of the connector body is modified by having an external threaded surface portion 90 with spaced external mounting portions 92 and 94 to facilitate mounting of wall plate W by means of the upper and lower spaced clamps 74' in the same manner as described with reference to FIGS. 1 to 4. The inner sleeve 23" of the barrel is made up of a relatively thin tubular section composed of plastic and which terminates in annular, radially extending returns 95 and 96 at opposite ends.

When the centering guide 14" is inserted into the connector body, as illustrated in FIG. 11, the leading end of the centering guide 14" will be centered by the forwardmost return 96, and the enlarged trailing end 43" will be centered by the return 95.

After the wall plate W is mounted on the outlet box B, the cable C' is prepared by exposing the inner pin conductor 44 and flaring the braided layer 46 over the jacket 47 followed by inserting the cable into a standard male F-connector body F, as shown in FIG. 12, the body F may, for example, be a Model FS6U manufactured and sold by ICM Corp. of Denver, Colo. Briefly, the connector body F has the same basic elements as those of the connector body N of FIG. 3, and the cable C' is mounted as described in FIGS. 1 to 4 but without an extension tip on the conductor pin 44. The conductor pin 44 is inserted into the bore 50" of the centering guide 14", and a nut 98 is journaled on the end of the connector F for threaded engagement with the threaded end of the barrel 90, as illustrated in FIG. 12. Again, the slotted end of the centering guide surrounding the bore 50" will undergo a slight expansion for snug-fitting engagement with the conductor pin 44".

The splice connector barrel portion 24' can be modified to substitute external mounting portions to define a groove 80' for a color band 82' in place of the mounting portions 92 and 94. Both with respect to the wall mount and color band version, the splice connector assembly obviates a second connector mounted on the first cable end and therefore the connection when crimped is much more positive as well as shorter and does not require as much space in the wall outlet box B or other wall opening.

It is therefore to be understood that while preferred forms of invention are herein set forth and described, the above and other modifications may be made therein without departing from the spirit and scope of the invention as defined by the appended claims and reasonable equivalents thereof.

I claim:

1. A coaxial cable splice connector for electrically connecting a pair of pin or wire-like conductors at ends of each of a pair of coaxial cables comprising:

a tubular splice connector body including an inner concentric connecting sleeve of electrically non-conductive material therein for insertion of one of said ends of said cables;

a centering guide of elongated cylindrical configuration having a recessed portion at a leading end thereof, said centering guide being electrically conductive and being mounted on one of said conductors, and said guide being axially advanced in centered relation to said sleeve; and another of said conductors being inserted into said recessed portion.

2. A cable splice connector according to claim 1 wherein said other conductor is inserted into said recessed portion in snug-fitting relation to said centering guide.

3. A cable splice connector according to claim 1 wherein said leading end of said centering guide projects through one end of said connector body.

4. A cable splice connector according to claim 1 wherein said recessed portion is of generally conical configuration tapering away from said leading end.

5. A cable splice connector according to claim 1 wherein a color band is mounted on an external surface of said connector body.

6. A cable splice connector according to claim 5 wherein said color band is composed of an elastic material and bears a color corresponding to the intended application of said splice connector.

7. A cable splice connector according to claim 5 wherein said color band is inserted in an external groove in said connector body.

8. A cable splice connector according to claim 7 wherein said color band is elastic and has at least one circumferentially extending rib.

9. A cable splice connector according to claim 1 wherein wall mounting means is provided for connecting said connector body to an electrical outlet box.

10. A cable splice connector according to claim 9 wherein said connector body has a first end disposed in said electrical outlet box for insertion of said one end of said cable and an opposite end to said first end protruding from said wall mounting means.

11. A coaxial cable splice connector for electrically connecting a pair of conductor pins at an end of each of a pair of first and second cables comprising:

a tubular connecting body having inner and outer spaced concentric sleeve members defining an annular space therebetween for insertion of one or more outer layers of one of said ends of said first cable, said sleeve members extending from one end of said body, a crimping ring mounted on said outer sleeve member and a barrel portion extending axially from said sleeve members including an inner concentric mounting sleeve of electrically non-conductive material therein;

a centering guide of elongated cylindrical configuration, said centering guide being electrically conductive and being mounted on said conductor pin at said one end of said first cable, said guide being axially slidable into a predetermined position in said connector body in centered relation to said mounting sleeve; and said second cable being inserted in said barrel in facing relation to said mounting sleeve for insertion of said conductor pin at said end of said second cable into a recessed portion at a leading end of said guide opposite to aid first cable.

12. A coaxial cable splice connector according to claim 11 wherein said guide includes an axial bore at each end for insertion of said conductor pins.

13. A coaxial cable splice connector according to claim 12 wherein said bores are tapered away from an entrance end for snug-fitting insertion of each of said conductor pins.

14. A coaxial cable splice connector according to claim 11 including wall mounting means for connecting said connector body in an electrical outlet box.

15. A cable splice connector according to claim 14 wherein said connector body has a first end disposed in said electrical outlet box for insertion of said one end of said cable and an opposite end to said first end protruding from said wall mounting means.

16. A splice connector assembly comprising:

a connector body having a cylindrical first insulator sleeve mounted therein;

an electrically conductive guide member including pin-receiving bores at opposite ends thereof, said guide member mounted in inner concentric relation to said insulator sleeve;

means for crimping a first cable end to one end of said connector body with a conductor pin or wire inserted into one of the pin-receiving bores; and a second cable end having a conductor pin or wire inserted into the other of said pin-receiving bores and said guide member is of elongated cylindrical configuration having arcuate segments at opposite ends thereof in surrounding relation to said pin-receiving bores.

17. An assembly according to claim 16 wherein a second insulator is interposed between said guide member and said first cable end.

18. An assembly according to claim 16 wherein said assembly includes wall mounting means on said connector body for connecting said connector body to a wall plate over an electrical outlet box.

19. An assembly according to claim 18 wherein said first cable is mounted in said box and is permanently connected by said crimping means to said connector body and an opposite end of said connector body extends through an opening in said wall plate.

20. An assembly according to claim 16 wherein an elastic color band is mounted on an external surface of said connector body.

* * * * *

UNITED STATES PATENT AND TRADEMARK OFFICE

CERTIFICATE OF CORRECTION

PATENT NO. : 7,059,900 B2
APPLICATION NO. : 10/885246
DATED : June 13, 2006
INVENTOR(S) : Holliday, R. A.

It is certified that error appears in the above-identified patent and that said Letters Patent is hereby corrected as shown below:

| Column No. | Line No. | Correction |
|---|---|---|
| 6 | 58 | Cancel “24' ” and substitute -- 24' ' -- |

In the Claims:

| Column No. | Line No. | Correction |
|---|---|---|
| 8 | 13 | Cancel “aid” and substitute -- said -- |

Signed and Sealed this

Fifteenth Day of August, 2006

JON W. DUDAS
*Director of the United States Patent and Trademark Office*